US010153114B2

(12) United States Patent
Tsutsui et al.

(10) Patent No.: US 10,153,114 B2
(45) Date of Patent: Dec. 11, 2018

(54) ELECTRONIC-DEVICE SEAL STRUCTURE AND ELECTROMAGNETIC RELAY USING SAID ELECTRONIC-DEVICE SEAL STRUCTURE

(71) Applicant: OMRON Corporation, Kyoto (JP)

(72) Inventors: Kazuhiro Tsutsui, Kumamoto (JP); Masahiro Kinoshita, Tokyo (JP); Ayaka Miyake, Kikuchi (JP); Jun Sasaki, Yamaga (JP); Keisuke Tsuji, Kusatsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 15/125,195

(22) PCT Filed: Nov. 21, 2014

(86) PCT No.: PCT/JP2014/080975
§ 371 (c)(1),
(2) Date: Sep. 12, 2016

(87) PCT Pub. No.: WO2015/136786
PCT Pub. Date: Sep. 17, 2015

(65) Prior Publication Data

US 2017/0076893 A1 Mar. 16, 2017

(30) Foreign Application Priority Data

Mar. 14, 2014 (JP) ..... 2014-052209

(51) Int. Cl.
*H01H 13/04* (2006.01)
*H01H 50/02* (2006.01)
*H01H 50/04* (2006.01)

(52) U.S. Cl.
CPC ..... *H01H 50/023* (2013.01); *H01H 50/043* (2013.01)

(58) Field of Classification Search
CPC .... H01H 51/22; H01H 50/023; H01H 50/041; H01H 50/64; H01H 50/38; H01H 9/20; H01H 67/02
(Continued)

(56) References Cited

U.S. PATENT DOCUMENTS 3,351,876 A * 11/1967 Conrad ..... H01P 3/085 174/72 B
4,185,163 A 1/1980 Schedele
(Continued)

FOREIGN PATENT DOCUMENTS

CN 1937132 3/2007
CN 103151225 6/2013
(Continued)

OTHER PUBLICATIONS

"International Search Report (Form PCT/ISA/210)", dated Feb. 17, 2015, with English translation thereof, pp. 1-4.
(Continued)

*Primary Examiner* — Shawki S Ismail
*Assistant Examiner* — Lisa Homza
(74) *Attorney, Agent, or Firm* — JCIPRNET

(57) ABSTRACT

An electronic-device seal structure includes a base, a case which covers an upper surface of the base and has an opening at a surface thereof, and a pair of terminals attached to the base. A first clearance sealed with a sealing material is provided between the base and the case, and a second clearance is provided between the pair of terminals attached to an end surface of the base to face each other.

12 Claims, 9 Drawing Sheets

(58) Field of Classification Search
USPC ..... 335/202
See application file for complete search history.

(56) References Cited

U.S. PATENT DOCUMENTS

| | | | | |
|---|---|---|---|---|
| 5,748,061 | A * | 5/1998 | Tsutsui | H01H 50/60 335/78 |
| 5,880,653 | A * | 3/1999 | Yamada | H01H 49/00 335/128 |
| 6,337,614 | B1 * | 1/2002 | Tsutsui | H01H 50/02 335/160 |
| 2002/0036556 | A1 * | 3/2002 | Matsuda | H01H 50/12 335/78 |
| 2002/0050883 | A1 * | 5/2002 | Miyazaki | H01H 50/36 335/128 |
| 2002/0130741 | A1 * | 9/2002 | Noguchi | H01H 50/042 335/128 |
| 2003/0034863 | A1 * | 2/2003 | Ono | H01H 50/042 335/128 |
| 2003/0067372 | A1 * | 4/2003 | Funayama | H01H 50/026 335/128 |
| 2004/0119566 | A1 * | 6/2004 | Sanada | H01H 50/642 335/128 |
| 2005/0057332 | A1 * | 3/2005 | Nakamura | H01H 50/042 335/128 |
| 2005/0068130 | A1 * | 3/2005 | Bergh | H01H 50/326 335/128 |
| 2006/0022778 | A1 * | 2/2006 | Minowa | H01H 50/36 335/128 |
| 2011/0221549 | A1 * | 9/2011 | Tsutsui | H01H 1/60 335/186 |
| 2011/0221690 | A1 * | 9/2011 | Miyoshi | G06F 3/0338 345/173 |
| 2014/0253269 | A1 * | 9/2014 | Yamauchi | H01H 49/00 335/202 |
| 2017/0076893 | A1 * | 3/2017 | Tsutsui | H01H 50/043 |

FOREIGN PATENT DOCUMENTS

| | | |
|---|---|---|
| JP | S52-139941 | 11/1977 |
| JP | S58-049855 | 4/1983 |
| JP | S61-178244 | 11/1986 |
| JP | H056254 | 1/1993 |
| JP | H07-085760 | 3/1995 |
| JP | 2000-260283 | 9/2000 |
| JP | 3714006 | 11/2005 |

OTHER PUBLICATIONS

"First Office Action of China Counterpart Application" with English translation thereof, dated May 31, 2017, p. 1-p. 14.

* cited by examiner (A) (B)

ELECTRONIC-DEVICE SEAL STRUCTURE AND ELECTROMAGNETIC RELAY USING SAID ELECTRONIC-DEVICE SEAL STRUCTURE

CROSS-REFERENCE TO RELATED APPLICATION

This application is a 371 of international application of PCT application serial no. PCT/JP2014/080975, filed on Nov. 21, 2014, which claims the priority benefit of Japan application no. JP 2014-052209, filed on Mar. 14, 2014. The entirety of each of the abovementioned patent applications is hereby incorporated by reference herein and made a part of this specification.

TECHNICAL FIELD

The present invention relates to an electronic-device seal structure and an electromagnetic relay using this electronic-device seal structure.

BACKGROUND ART

Japanese Unexamined Patent Application Publication No. 2000-260283 (Patent Literature 1) discloses one example of an electromagnetic-relay seal structure. In this seal structure, an opening side of a case is filled with a sealing material and cured, to ensure sealing properties inside the case. For preventing inflow of the sealing material through the opening where a movable terminal is protruded, a projection is provided inside a case, and/or a cut-and-raised part is provided in a movable contact terminal.

CITATION LIST

Patent Literature

Patent Literature 1: Japanese Unexamined Patent Application Publication No. 2000-260283

SUMMARY

Technical Problem

However, in the conventional seal structure, a component such as the case or the movable contact terminal is required to have high accuracy, thus causing problems where variations tend to occur in sealing properties inside the case and manufacturing cost is high.

In view of the foregoing problems, the present invention provides an electronic-device seal structure that facilitates manufacturing of an electronic device and enables reduction in manufacturing cost.

Solution to Problem

In order to solve the above problems, an electronic-device seal structure according to one embodiment of the present invention comprises: a base; a case which covers an upper surface of the base and has an opening at a surface thereof; and a pair of terminals attached to the base, wherein a first clearance sealed with a sealing material is provided between the base and the case, characterized in that wherein a second clearance is provided between the pair of terminals disposed on an end surface of the base to face each other.

Advantageous Effect of Invention

With the electronic-device seal structure according to this embodiment of the present invention, the second clearance is provided between the pair of terminals disposed on the end surface of the base to face each other so that a space inside the case can be sealed by the sealing material, thereby eliminating the need for the component with high component accuracy. This facilitates manufacturing of the electronic device and enables reduction in manufacturing cost.

In one embodiment of the present invention, the electronic-device seal structure further comprises: clearance forming portions, which form the second clearance and are provided on bases of the pair of terminals to face each other.

According to this embodiment, an electronic device with high flexibility in design can be obtained.

In one embodiment of the present invention, each of the pair of terminals is a laminate configured by folding and superimposing a plate-like member.

According to this embodiment, an electronic device with high flexibility in design can be obtained.

In one embodiment of the present invention, a dimension from a body of each of the pair of terminals to an inner surface of the case is not smaller than 0.16 mm and not larger than 0.25 mm, the second clearance between the clearance forming portions is not larger than 2.0 mm, a longitudinal dimension of a facing portion of each of the clearance forming portions is not larger than 2.1 mm, and the sealing material has a viscosity of 39000 to 48000 mPa·s in a range of 25±5° C.

According to this embodiment, it is possible to reduce an inflow distance of the sealing material that flows from the second clearance between the clearance forming portions to the inside of the case by setting the second clearance to not larger than 2.0 mm when the dimension from the body of the terminal to the inner surface of the case is set to not smaller than 0.16 mm and not larger than 0.25 mm, the longitudinal dimension of the facing portion of each of the clearance forming portions of the pair of terminals is set to not larger than 2.1 mm, and the sealing material with the viscosity of 39000 to 48000 mPa·s in the range of 25±5° C. is used. This eliminates the need to prevent the inflow of the sealing material to the inside of the case by providing a configuration such as a projection or a cut-and-raised part in the movable contact terminal or by increasing a height dimension of the electronic device, so as to prevent the inflow of the sealing material to the inside of the case. As a result, the manufacturing cost of the electronic device can be reduced.

When a sealing material with a viscosity smaller than 39000 mPa·s in the range of 25±5° C. is used, the sealing material flows to the deep inside of the case 30. When a sealing material with a viscosity larger than 48000 mPa·s in the range of 25±5° C. is used, the sealing material cannot sufficiently fill the first clearance between the base and the case, and cannot ensure the sealing properties inside the case. Therefore, the use of the sealing material with the above temperature and viscosity facilitates control of the sealing material that flows to the inside of the case, while maintaining the sealing properties inside the case.

In one embodiment of the present invention, the second clearance between the pair of terminals is not larger than 0.5 mm.

According to this embodiment, it is possible to reliably reduce the inflow distance of the sealing material from the second clearance between the clearance forming portions to the inside of the case, and thereby to reduce the manufacturing cost of the electronic device.

In one embodiment of the present invention, the first clearance between the base and the case is not smaller than 0.01 mm and not larger than 0.10 mm.

According to this embodiment, when the first clearance between the base and the case is less than 0.01 mm, capillarity action might occur to cause the sealing material to flow to the inside of the case. Further, when the first clearance between the base and the case is more than 0.10 mm, it becomes difficult to control the inflow of the sealing material to the inside of the case. Thus, providing the first clearance with the above dimension facilitates control of the sealing material that flows to the inside of the case.

In one embodiment of the present invention, the electronic-device seal structure further comprises: tapered portions provided at facing edges of the pair of terminals.

According to this embodiment, it becomes easier to control the sealing material that flows to the inside of the case.

In one embodiment of the present invention, an angle of each of the tapered portions is not smaller than 20°.

According to this embodiment, it becomes easier to control the sealing material that flows to the inside of the case.

An electromagnetic relay according to one embodiment of the present invention is characterized by having the electronic-device seal structure.

According to this embodiment of the present invention, it is possible to obtain an electromagnetic relay that is manufactured with ease at low cost.

DESCRIPTION OF EMBODIMENTS

Hereinafter, an electromagnetic relay according to one embodiment of the present invention will be described in accordance with the attached drawings.

Figure 1:
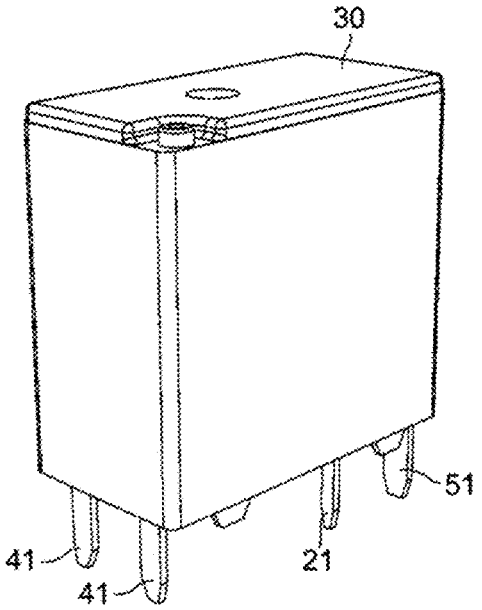
FIG. 1 is a perspective view showing an electromagnetic relay that is an electronic device according to one embodiment of the present invention.
Figure 2:
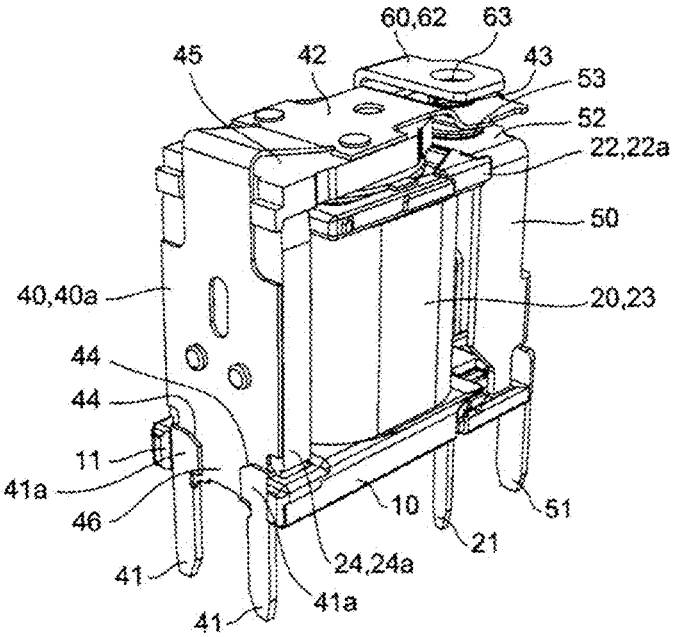
FIG. 2 is a perspective view showing a state in which a case of the electromagnetic relay in FIG. 1 has been removed.
Figure 5:
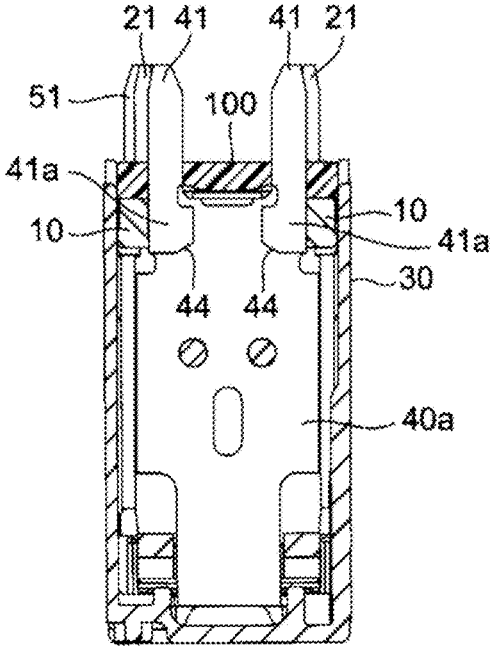
FIG. 5 is a longitudinal sectional view showing a state in the middle of the sealing of the bottom surface of the electromagnetic relay in FIG. 1 with the epoxy resin, with a direction, from which the epoxy resin is poured, oriented upward.
Figure 6:
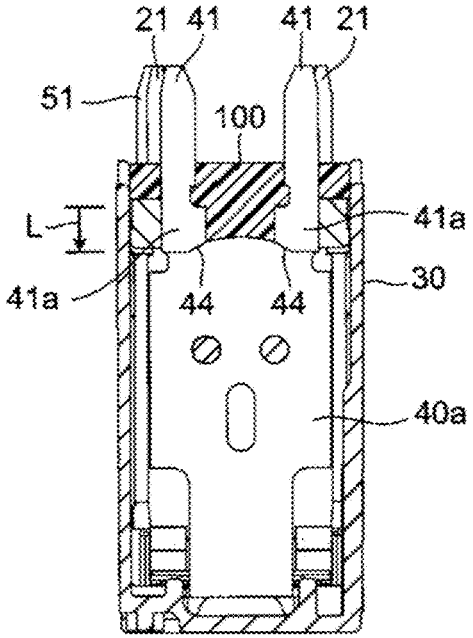
FIG. 6 is a longitudinal sectional view showing a state after the sealing of the bottom surface of the electromagnetic relay in FIG. 1 with the epoxy resin, with the direction, from which the epoxy resin is poured, oriented upward.

As shown in FIGS. 1 and 2, an electromagnetic relay according to one embodiment of the present embodiment includes a base 10, an electromagnet unit 20 provided on this base 10, and a case 30 that covers the base 10 and the electromagnet unit 20. The electromagnet unit 20 is assembled with a movable contact terminal 40, a normally-open fixed contact terminal 50, and a normally-closed fixed contact part 60. Further, as shown in FIGS. 5 and 6, in the electromagnetic relay, an internal space in the case 30 is sealed with a sealing material (sealant) 100. Note that the sealing material 100 is shown only in FIGS. 5 and 6 for convenience of the description.

As shown in FIG. 2, the base 10 has notches 11 (only one of notches 11 is shown in FIG. 2) at both ends in a width direction for protruding movable terminal parts 41, 41 and a fixed terminal part 51 downward. Further, although not shown in the drawings, the base 10 is provided with a terminal hole into which coil terminals 21 are pressed, and press holes for fixing the normally-open fixed contact terminal 50 and the normally-closed fixed contact part 60, and the like.

As shown in FIG. 2, the electromagnet unit 20 has a spool 22 integrally molded into the base 10, a coil 23 wound around a trunk of this spool 22, and a yoke 24 having an L-shaped cross section and assembled to the spool 22. A flange 22*a* is provided in an upper part of the spool 22. The yoke 24 is made up of a vertical portion 24*a* extending along the coil 23, and a horizontal portion, not shown. The lower end of an iron core (not shown) inserted into the trunk of the spool 22 is swaged and fixed to the horizontal portion.

Figure 4:
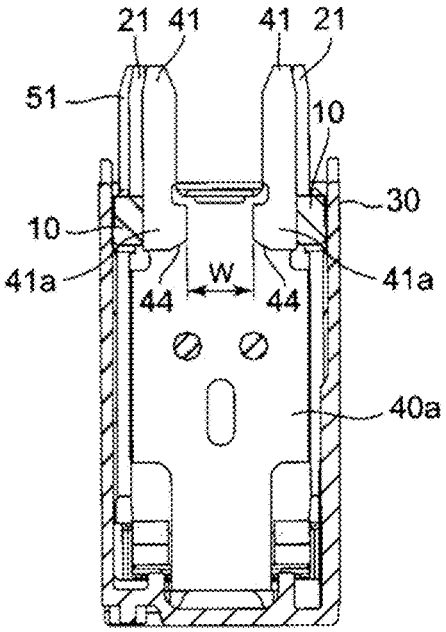
FIG. 4 is a longitudinal sectional view showing a state before sealing of the bottom surface of the electromagnetic relay in FIG. 1 with epoxy resin.

As shown in FIG. 4, the case 30 has a boxed shape with an opening at one surface thereof, and has an external shape fittable to the base 10.

As shown in FIG. 2, the movable contact terminal 40 is formed of a conductive plate spring with a substantially L shape, and has a body 40*a*, a pair of movable terminal parts 41, 41 at one end of the body 40*a*, and a movable contact piece 42 at the other end of the body 40*a*. This movable contact piece 42 is provided with a movable contact 43 at its free end and a movable iron piece 45 on its lower surface. The movable contact terminal 40 is swaged and fixed to the vertical portion 24*a* of the yoke 24.

The movable terminal parts 41, 41 are formed by folding plate springs at 180° and crimping them by a press (so-called hemming bending), and are disposed at one end of the body 40*a* so as to face each other with a predetermined interval. In the bases of the movable terminal parts 41, 41, there are provided clearance forming portions 41*a*, 41*a* formed by bending and crimping the plate springs onto the body 40*a*. A clearance 46 (second clearance) is defined by the clearance forming portions 41*a*, 41*a* on the body 40*a*. Further, tapered portions 44, 44 are respectively provided at the facing upper end edges of the clearance forming portions 41*a*, 41*a*.

As shown in FIG. 2, the normally-open fixed contact terminal 50 has a horizontal portion 52 provided with a normally-open fixed contact 53 at its upper end, and has the fixed terminal part 51 at its lower end. Further, a pressing terminal part, not shown, is provided on a lower end of the normally-open fixed contact terminal 50. By pressing this pressing terminal part into the press hole of the base 10, the normally-open fixed contact terminal 50 is fixed to the base 10.

As shown in FIG. 2, the normally-closed fixed contact part 60 has a horizontal portion 62 provided with a normally-closed fixed contact 63 at its upper end. Further, a pressing terminal part, not shown, is provided at the lower end of the normally-closed fixed contact part 60. By pressing this pressing terminal part into the press hole of the base 10, the normally-closed fixed contact part 60 is fixed to the base 10.

Next, a procedure of assembling the electromagnetic relay will be described.

First, the coil 23 is wound around the trunk of the spool 22 with the coil terminals 21, 21 pressed to the base 10. Then, lead wires of this coil 23 are bound and soldered to the coil terminals 21, 21.

Next, an iron core is inserted into the trunk of the spool 22, and this iron core is swaged and fixed to the horizontal portion of the yoke 24 assembled to the base 10, to be formed into one piece.

Subsequently, the movable contact terminal 40 is swaged and fixed to the vertical portion 24*a* of the yoke 24, and the normally-open fixed contact terminal 50 and the normally-closed fixed contact part 60 are fixed to the base 10. At this time, the movable iron piece 45 is rotatably supported by the upper end of the yoke 24, and the movable contact 43 faces the normally-open fixed contact 53 and the normally-closed fixed contact 63 so as to alternately contact with/separate from the normally-open fixed contact 53 and alternately contact with/separate from the normally-closed fixed contact 63.

Finally, the case 30 is fitted to the base 10, and thereafter, curable resin is poured as the sealing material 100 into a recess 70 formed of the bottom surface of the base 10 and the opening edge of the case 30 (see FIG. 4). Then, the sealing material 100 is cured to complete the assembly operation.

Here, the sealing material 100 is preferably curable resin with a viscosity from 39000 to 48000 mPa·s, measured in the range of normal temperature (25±5° C.) in conformity to JIS K-6833 Section 6.3.

This is because, when curable resin with a viscosity of less than 39000 mPa·s at normal temperature is used, the curable resin does not stay in the recess 70, but flows to the deep inside of the case 30. When curable resin with a viscosity of more than 48000 mPa·s at normal temperature is used, the curable resin cannot sufficiently fill a clearance (first clearance) between the base 10 and the case 30, and cannot ensure the sealing properties inside the case 30.

Note that examples of the curable resin include thermosetting resin, ultraviolet curable resin, and anaerobic curable resin.

Figure 3:
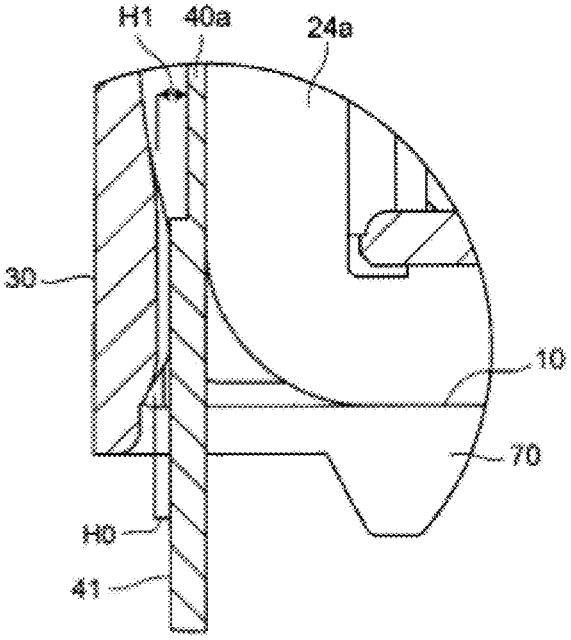
FIG. 3 is an enlarged transverse sectional view showing a movable contact terminal of the electromagnetic relay in FIG. 1.

Further, when the foregoing curable resin is to be used as the sealing material 100, at the time of fitting of the case 30 to the base 10, it is preferable to provide a clearance with a dimension H0 (shown in FIG. 3) of not smaller than 0.01 mm and not larger than 0.10 mm between a side surface of the base 10 and the inner surface of the case 30 except for a part of the movable contact terminal 40, and it is more preferable to provide a clearance with a dimension H0 of 0.05 mm.

This is because, when the dimension H0 of the clearance between the side surface of the base 10 and the inner surface of the case 30 is smaller than 0.01 mm, capillarity action might occur to cause the curable resin to flow to the inside of the case 30. When the dimension H0 of the clearance between the side surface of the base 10 and the inner surface of the case 30 is larger than 0.10 mm, it becomes difficult to control the inflow of the curable resin to the inside of the case 30.

Note that the dimension H0 of the clearance is a dimension of the clearance between the inner surface of the case 30 and the outer surface of the base 10 in the state of being fitted with the electromagnet unit 20, the movable contact terminal 40, the normally-open fixed contact terminal 50, and the normally-closed fixed contact part 60. Hence, a dimensional tolerance of the clearance between the outer surface of the base 10 and the inner surface of the case 30 may be set within a range of not smaller than 0.01 mm and not larger than 0.10 mm.

Subsequently, the seal structure of the movable contact terminal 40 will be described using FIGS. 4 to 6.

As shown in FIG. 4, the assembled electromagnetic relay is turned upside down, and the sealing material 100 is poured into the recess 70. As shown in FIG. 5, the recess 70 is filled with the sealing material 100. The sealing material 100 thus filled flows down from the clearance between the base 10 and the case 30 to the inside of the case 30 as the time passes until the sealing material 100 is cured.

In the movable contact terminal 40, the clearance 46 is defined between the movable terminal parts 41, 41. In this clearance 46, a dimension H1 (shown in FIG. 3) between the body 40*a* of the movable contact terminal 40 and the inner surface of the case 30 is larger than the dimension H0 by a thickness of the plate spring. Thus, as shown in FIG. 6, an inflow distance L of the sealing material 100 that flows from the clearance 46 between the movable terminal parts 41, 41 toward the inside of the case 30 becomes longer than an inflow distance of the sealing material 100 that flows from the clearance between the base 10 and the case 30 toward the inside of the case 30.

When the foregoing curable resin is used as the sealing material 100 and the movable contact terminal 40 is formed of the plate spring with a thickness of 0.15 mm such that a longitudinal dimension L (shown in FIG. 6) of the facing portion of each of the clearance forming portions 41*a* is 2.1 mm (i.e., when H1 is in a range of not smaller than 0.16 mm and not larger than 0.25 mm), a dimension W (shown in FIG. 4) of the clearance 46 is preferably not larger than 2.0 mm, and more preferably not larger than 0.5 mm. Setting the dimension W of the clearance 46 to not larger than 2.0 mm, preferably to not larger than 0.5 mm, can reduce the inflow distance of the sealing material 100 that flows from the clearance 46 to the inside of the case 30. This eliminates the need to prevent the inflow of the sealing material 100 to the inside of the case 30 by providing a configuration such as a projection or a cut-and-raised part in the movable contact terminal 40, or by increasing a height dimension of the electromagnetic relay, in order to prevent the inflow of the sealing material 100 to the inside of the case 30. As a result, the manufacturing cost of the electromagnetic relay can be reduced.

On the other hand, when the dimension W of the clearance 46 is larger than 2.0 mm, it becomes difficult to control the inflow of the curable resin to the inside of the case 30.

Further, providing the tapered portions 44, 44 at the upper end edges of the clearance forming portions 41*a* of the movable contact terminal 40 can reliably reduce the inflow of the sealing material 100 to the inside of the case 30.

Note that the angles (tapered angles) of the tapered portions 44, 44 are preferably not smaller than 20°. Setting the tapered angle to not smaller than 20° can reliably reduce the inflow of the sealing material 100 to the inside of the case 30.

In the electromagnetic relay, the clearance forming portion 41*a* is provided in each of the movable terminal parts 41, 41, but this is not restrictive. If possible, the clearance forming portion 41*a* may be provided in the fixed terminal part or the coil terminal, for example.

Note that forming the clearance forming portion so as to prevent formation of the clearance 46 can reduce an amount of inflow of the sealing material 100 to the inside of the case 30. However, when such a movable contact terminal is to be manufactured, it is necessary to process the plate spring such that the plate spring can cover the clearance between the clearance forming portions on the body at the time of hemming bending, thus making a feed pitch of the plate spring large to cause deterioration in cutting layout efficiency.

In contrast, in the above electromagnetic relay, since the clearance 46 is defined between the clearance forming portions 41*a*, 41*a*, it is possible to make small the width dimension of the plate spring for forming each of the movable terminal parts 41, 41, while reducing the amount of inflow of the sealing material 100 to the inside of the case 30. Hence, it is possible to improve the cutting layout efficiency while reducing the feed pitch of the plate spring, and thereby to enhance the productivity of the electromagnetic relay.

Working Example 1

Working Example 1-1

Figure 7A:
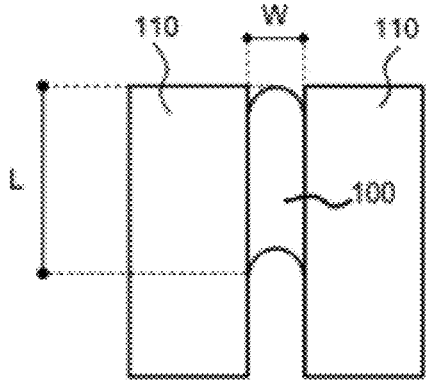
FIGS. 7A and 7B show Working Example 1.
Figure 7B:
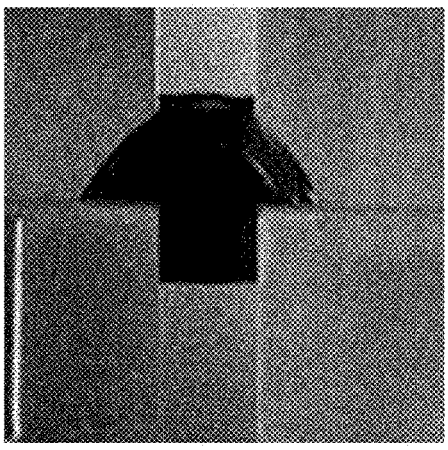

As shown in FIG. 7A, plate springs 110, 110 constituting the movable contact terminal 40 were disposed facing each other so as to form a clearance of W1=2.0 mm by a thickness gauge, the curable resin was poured into this clearance, and an inflow distance rL of the curable resin into the clearance was measured.

(Measurement Conditions)

Measurement was performed at an ambient temperature of 25±5° C.

As the curable resin, there was used epoxy resin with a viscosity of 39000 to 48000 mPa·s at an ambient temperature in the range of 25±5° C.

As the plate spring 110, a thin stainless steel plate was used.

After pouring of the curable resin, the curable resin was allowed to stand for one hour or longer, and an inflow distance rL1 was measured.

(Result)

As a result of the measurement, the inflow distance rL1 of the curable resin was 2.1 mm.

Comparative Example 1

An inflow distance rL0 of the curable resin was measured in similar conditions to those in Working Example 1-1 except that the clearance between the plate springs 110, 110 was set to W0=0.5 mm.

(Result)

As a result of the measurement, the inflow distance rL0 of the curable resin was 1.7 mm.

(Consideration)

From the results of Working Example 1-1 and Comparative Example 1, it was found that narrowing the clearance between the plate springs 110, 110 from W1=2.0 mm to W0=0.5 mm leads to a decrease in value of the inflow distance rL of the curable resin.

Working Example 1-2

An inflow distance rL2 of the curable resin was measured in similar conditions to those in Working Example 1-1 except that the clearance between the plate springs 110, 110 was set to W2=4.0 min.

(Result)

As a result of the measurement, the inflow distance rL2 of the curable resin was 6.5 mm.

(Consideration)

From the results of Working Example 1-2 and Comparative Example 1, it was found that widening the clearance between the plate springs 110, 110 from W0=0.5 mm to W2=4.0 mm leads to an increase in value of the inflow distance rL of the curable resin.

Working Example 2

Working Example 2-1

Figure 8A:
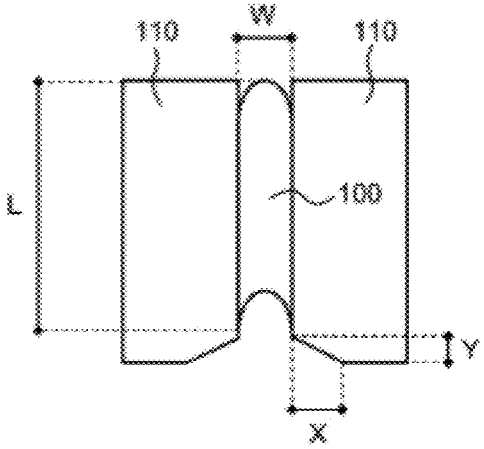
FIGS. 8A and 8B show Working Example 2.
Figure 8B:
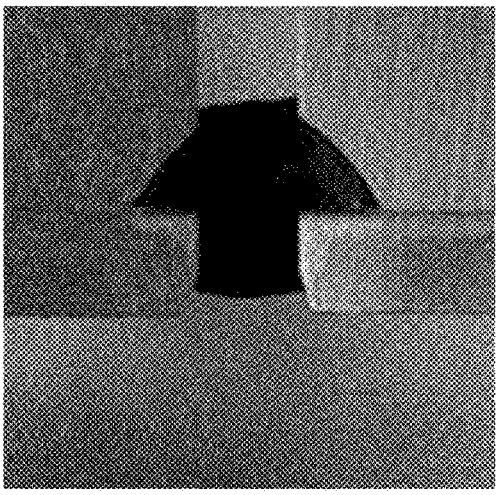

As shown in FIG. 8A, the plate springs 110 were disposed facing each other so as to form a clearance of W=2.0 mm by the thickness gauge, the curable resin was poured into this clearance, and an inflow distance rL of the curable resin into the clearance was measured. At the lower end edge of the plate spring 110 of this working example, a tapered portion (a tapered angle of about 20°) formed with dimensions of X=0.88 mm and Y=0.3 mm was provided.

(Measurement Conditions)

Measurement was performed at an ambient temperature of 25±5° C.

As the curable resin, there was used epoxy resin with a viscosity of 39000 to 48000 mPa·s at an ambient temperature in the range of 25±5° C.

As the plate spring 110, a thin stainless steel plate was used.

After pouring of the curable resin, the curable resin was allowed to stand for one hour or longer, and an inflow distance rL1 was measured.

(Result)

As a result of the measurement, the inflow distance rL1 of the curable resin was 1.8 mm.

Comparative Example 2

An inflow distance rL0 of the curable resin was measured in similar conditions to those in Working Example 2-1 except that no tapered portion was provided.

(Result)

As a result of the measurement, the inflow distance rL0 of the curable resin was 1.9 mm.

(Consideration)

From the results of Working Example 2-1 and Comparative Example 2, it was found that providing the tapered portions leads to a decrease in value of the inflow distance rL of the curable resin.

Working Example 2-2

An inflow distance rL2 of the curable resin was measured in similar conditions to those in Working Example 2-1 except that the tapered portion was formed with dimensions of X=0.35 mm and Y=0.3 mm (a tapered angle of about 60°).

(Result)

As a result of the measurement, the inflow distance rL2 of the curable resin was 1.7 mm.

(Consideration)

From the results of Working Example 2-2 and Comparative Example 2, it was found that increasing the angle of the tapered portion leads to a decrease in value of the inflow distance rL of the curable resin.

Working Example 3

The flow of the curable resin was observed after filling of the recess of the electromagnetic relay shown in FIG. 1 with the curable resin until curing of the curable resin.

(Measurement Conditions)

Figure 9A:
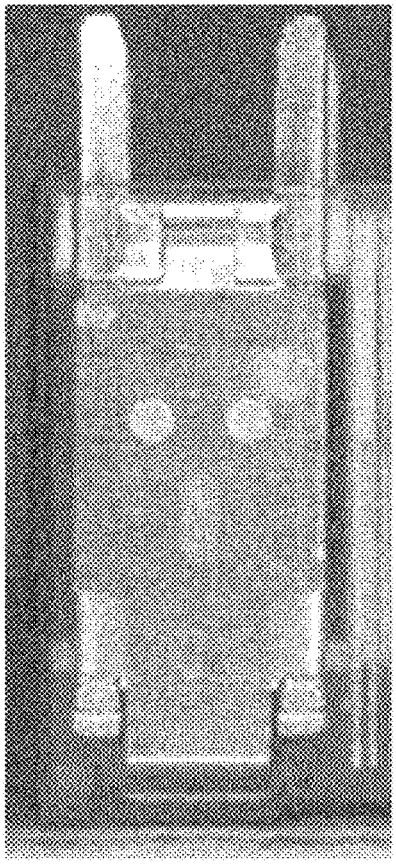
FIGS. 9A and 9B show Working Example 3.

The electromagnetic relay with the configuration shown in FIG. 1 was used. In this electromagnetic relay, a plate spring with a thickness of 0.15 mm was used for the movable contact terminal not provided with the tapered portion, and the thickness of the movable terminal part was set to 0.30 mm. Further, a clearance of W=2.0 mm (a dimension, H1=0.20 mm, of the clearance between the base and the body) was provided between the clearance forming portions on the bodies of the movable contact terminals. For observing the inflow of the curable resin into the clearance between the clearance forming portions, a transparent case was used (sec FIG. 9A).

As the plate spring, a thin stainless steel plate was used.

A dimensional tolerance of the clearance between the outer surface of the base and the inner surface of the case was set to a range of not smaller than 0.01 min and not larger than 0.10 mm.

The measurement was performed at an ambient temperature of 23° C.

As the curable resin, there was used epoxy resin with a viscosity of 39000 to 48000 mPa·s at an ambient temperature in the range of 25±5° C.

(Measurement Method)

After filling of the recess of the electromagnetic relay with the curable resin, the curable resin was allowed to stand. The curable resin that flows into the clearance between the movable terminal parts was then photographed every one minute until 30 minutes elapsed from the filling with the curable resin.

Next, the electromagnetic relay was put into a thermostatic oven at 50° C., and the curable resin that flows into the clearance between the clearance forming portions was photographed every five minutes until 250 minutes elapsed from the filling with the curable resin. The electromagnetic relay was taken out from the thermostatic oven every five minutes, for performing the photographing.

(Result)

Figure 10A:
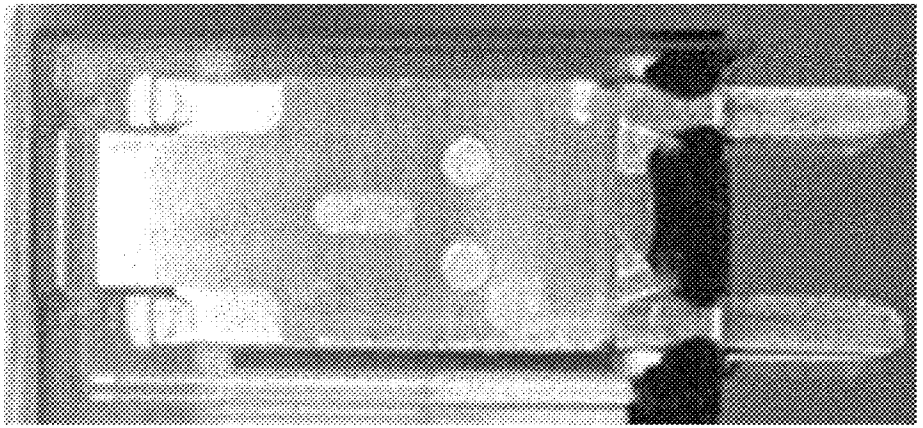
FIGS. 10A and 10B show Working Example 3 subsequent to FIGS. 9A and 9B.
Figure 11:
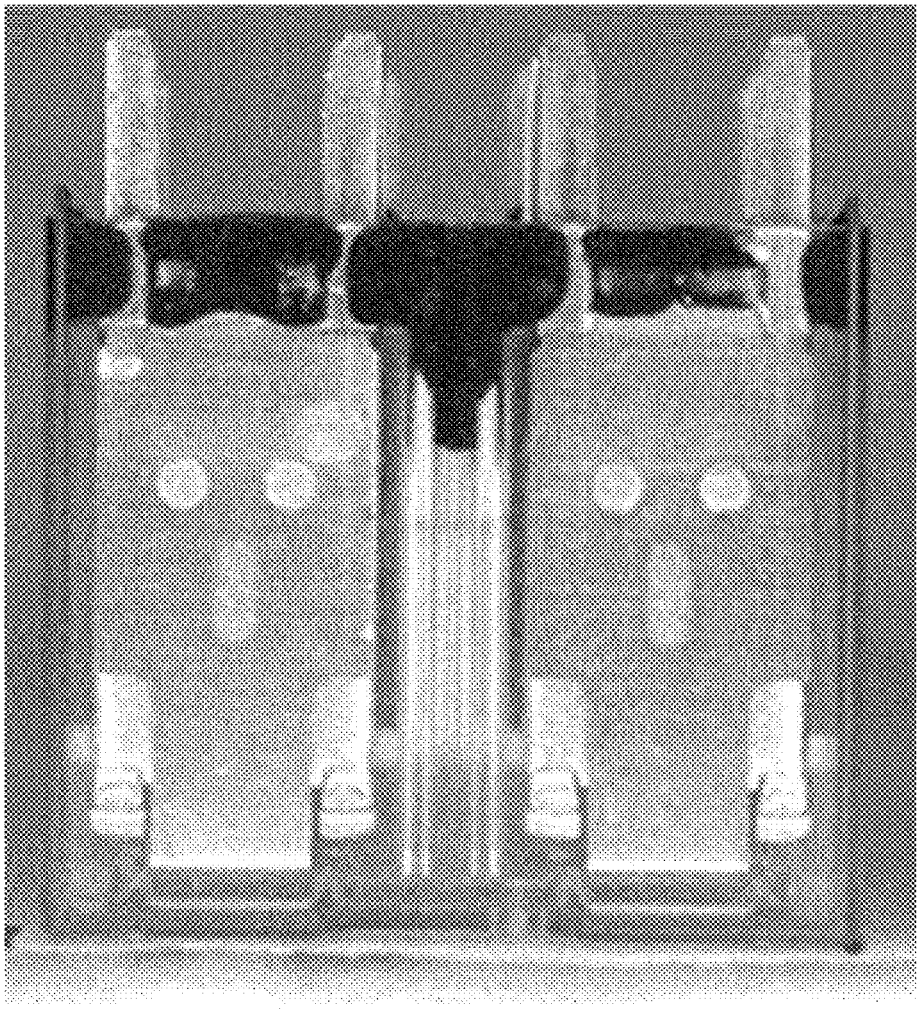
FIG. 11 shows Working Example 3 subsequent to FIGS. 10A and 10B.

As a result of the observation, at normal temperature, the inflow of the curable resin was stopped in about 15 minutes, and became immobilized (see FIG. 10A). Further, after the putting into the thermostatic oven, the inflow of the curable resin was stopped in about 60 minutes, and became immobilized (see the views (A) and (B) of FIG. 11). It was thereby found that, even after the lapse of the time, the curable resin does not flow to the inside of the case from the clearance between the clearance forming portions on the bodies.

Comparative Example 3

Figure 9B:
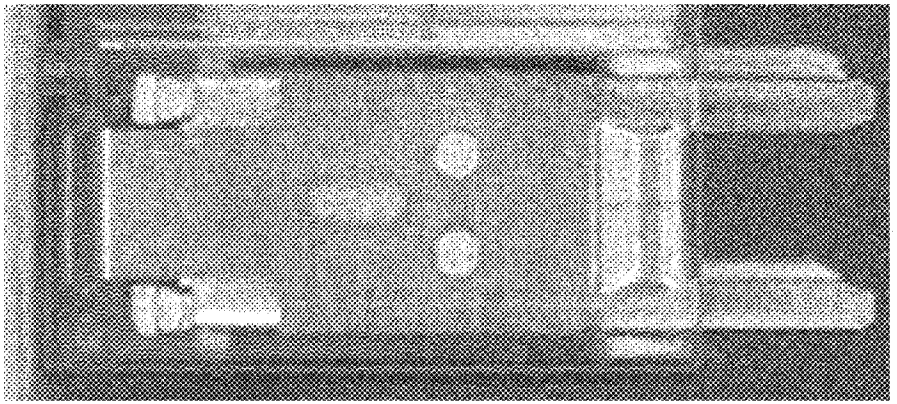

The flow of the curable resin was observed after filling of the recess of the electromagnetic relay with the curable resin until curing of the curable resin in similar conditions to those in Working Example 3 except that a movable contact terminal having a shape with a closed clearance between the clearance forming portions was used (see FIG. 9B).

(Result)

Figure 10B:
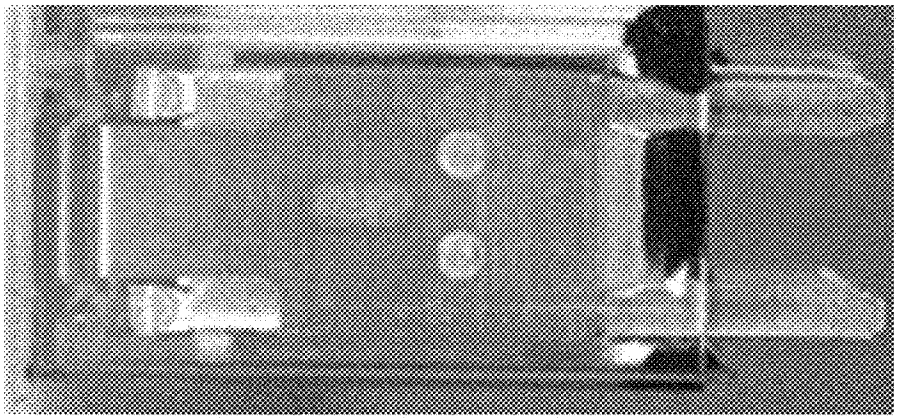

As a result of the observation, at normal temperature, the inflow of the curable resin was stopped in about 15 minutes, and became immobilized (see FIG. 10B). Further, after the putting into the thermostatic oven, the inflow of the curable resin was stopped in about 60 minutes, and became immobilized (see FIG. 11). It was thereby found that, even after the lapse of the time, the curable resin does not flow from between the movable terminal parts to the inside of the case.

(Consideration)

From the results of Working Example 3 and Comparative Example 3, it was found that the inflow of the curable resin to the inside of the case can be reduced even without completely closing the clearance between the movable terminal parts.

It was found from Working Example 1 and Working Example 3 above that, when the epoxy resin with a viscosity of 39000 to 48000 mPa·s at an ambient temperature in the range of 25±5° C. was used as the curable resin and the movable contact terminal was formed of a plate spring with a thickness of 0.15 mm such that the height dimension L of the clearance forming portion 41*a* was 2.1 mm (the dimension H1 of the clearance between the base and the body of the clearance forming portion was in the range of not smaller than 0.16 mm and not larger than 0.26 mm), it is possible to reduce the inflow distance rL of the curable resin that flows from the clearance between the clearance forming portions to the inside of the case to not longer than 2.1 mm by setting the dimension of the clearance to W=2.0 mm. Further, it was found from Working Example 2 that providing the tapered portion at each of the facing edges of the movable contact part and increasing the tapered angle of this tapered portion can lead to reduction in the inflow distance rL of the curable resin that flows from the clearance between the clearance forming portions to the inside of the case.

INDUSTRIAL APPLICABILITY

The seal structure according to the present invention is not restricted to the foregoing electromagnetic relay, but is also applicable to any electronic devices such as a switch and a sensor.

REFERENCE SIGNS LIST

10 base
11 notch
20 electromagnet unit
21 coil terminal
22 spool
22*a* flange
23 coil
24 yoke
24*a* vertical portion
30 case
40 movable contact terminal
40*a* body
41 movable terminal part
41*a* clearance forming portion
42 movable contact piece
43 movable contact
44 tapered portion
45 movable iron piece
46 clearance
50 normally-open fixed contact terminal
51 fixed terminal
52 horizontal portion
53 normally-open fixed contact
60 normally-closed fixed contact part
62 horizontal portion
63 normally-closed fixed contact

70 recess
100 sealing material
110 thickness gauge

The invention claimed is:

1. An electronic-device seal structure, comprising:
a base;
a case which covers an upper surface of the base and has an opening at a surface thereof; and
a terminal, which is attached to the base, having a body and a pair of terminal parts at one end of the body, wherein
a seal is formed between the base and the case,
a clearance is provided between the pair of terminal parts disposed on an end surface of the base to face each other and is surrounded by the pair of terminal parts, the body of the terminal, and the case,
clearance forming portions, which form the clearance and are provided on bases of the pair of terminal parts to face each other,
a dimension from the body of each of the pair of terminal parts to an inner surface of the case is not smaller than 0.16 mm and not larger than 0.25 mm,
the clearance between the clearance forming portions is not larger than 2.0 mm, and
a longitudinal dimension of a facing portion of each of the clearance forming portions is not larger than 2.1 mm, and the seal is formed by a material having a viscosity of 39000 to 48000 mPa·s in a range of 25±5° C.

2. The electronic-device seal structure as claimed in claim 1, wherein
each of the pair of terminal parts is a laminate configured by folding and superimposing a plate-like member.

3. The electronic-device seal structure as claimed in claim 1, wherein
the clearance between the pair of terminal parts is not larger than 0.5 mm.

4. The electronic-device seal structure as claimed in claim 1, wherein
the electronic-device seal structure further comprises tapered portions, provided at facing edges of the pair of terminal parts.

5. The electronic-device seal structure as claimed in claim 4, wherein
an angle of each of the tapered portions is not smaller than 20°.

6. An electromagnetic relay, comprising:
an electronic-device seal structure claimed in claim 1.

7. An electronic-device seal structure, comprising:
a base;
a case which covers an upper surface of the base and has an opening at a surface thereof; and
a pair of terminals attached to the base, wherein
a first clearance sealed with a sealing material is provided between the base and the case,
a second clearance is provided between the pair of terminals disposed on an end surface of the base to face each other,
clearance forming portions, which form the second clearance and are provided on bases of the pair of terminals to face each other,
a dimension from a body of each of the pair of terminals to an inner surface of the case is not smaller than 0.16 mm and not larger than 0.25 mm,
the second clearance between the clearance forming portions is not larger than 2.0 mm, and
a longitudinal dimension of a facing portion of each of the clearance forming portions is not larger than 2.1 mm, and the sealing material has a viscosity of 39000 to 48000 mPa·s in a range of 25±5° C.

8. The electronic-device seal structure as claimed in claim 7, wherein
each of the pair of terminals is a laminate configured by folding and superimposing a plate-like member.

9. The electronic-device seal structure as claimed in claim 7, wherein
the second clearance between the pair of terminals is not larger than 0.5 mm.

10. An electronic-device seal structure, comprising:
a base;
a case which covers an upper surface of the base and has an opening at a surface thereof; and
a terminal, which is attached to the base, having a body and a pair of terminal parts at one end of the body, wherein
a sealing material is disposed between the base and the case, sealing the case and the base together,
a clearance is provided between the pair of terminal parts disposed on an end surface of the base to face each other and is surrounded by the pair of terminal parts, the body of the terminal, and the case,
the clearance is disposed on the body of the terminal,
clearance forming portions, which form the clearance and are provided on bases of the pair of terminal parts to face each other,
a dimension from the body of each of the pair of terminal parts to an inner surface of the case is not smaller than 0.16 mm and not larger than 0.25 mm,
the clearance between the clearance forming portions is not larger than 2.0 mm, and
a longitudinal dimension of a facing portion of each of the clearance forming portions is not larger than 2.1 mm, and the sealing material has a viscosity of 39000 to 48000 mPa s in a range of 25±5° C.

11. The electronic-device seal structure as claimed in claim 10, wherein
each of the pair of terminal parts is a laminate configured by folding and superimposing a plate-like member.

12. The electronic-device seal structure as claimed in claim 10, wherein
the clearance between the pair of terminal parts is not larger than 0.5 mm.

* * * * *